US006689722B1

(12) United States Patent
Holst-Grubbe et al.

(10) Patent No.: US 6,689,722 B1
(45) Date of Patent: Feb. 10, 2004

(54) METHOD OF MANUFACTURING ENVIRONMENTALLY SAFE LUBRICATING COMPOSITION

(75) Inventors: David Peter Holst-Grubbe, Torrington, CT (US); Maurice Leroy Oyanadel, Cornwall, CT (US)

(73) Assignee: Pantera, Inc., Torrington, CT (US)

( * ) Notice: Subject to any disclaimer, the term of this patent is extended or adjusted under 35 U.S.C. 154(b) by 74 days.

(21) Appl. No.: 10/176,227

(22) Filed: Jun. 20, 2002

(51) Int. Cl.[7] ..... C10M 125/22
(52) U.S. Cl. ..... 508/167
(58) Field of Search ..... 508/167

(56) References Cited

U.S. PATENT DOCUMENTS

| | | | | |
|---|---|---|---|---|
| 3,249,538 A | | 5/1966 | Freier et al. | |
| 4,115,282 A | * | 9/1978 | Grasshoff | 508/116 |
| 4,203,854 A | | 5/1980 | Silverstein | |
| 4,715,972 A | | 12/1987 | Pacholke | |
| 5,549,836 A | * | 8/1996 | Moses | 508/183 |
| 5,792,728 A | | 8/1998 | Yuan et al. | |
| 5,922,657 A | * | 7/1999 | Camenzind et al. | 508/430 |

FOREIGN PATENT DOCUMENTS

JP 58001795 * 1/1983

OTHER PUBLICATIONS

Product Information—Cargill Industrial Oils & Lubricants, Agri–Pure™ 310 High Oleic Vegetable Base Trimethylolpropone Trioleate, www.techoils.cargill.com/products/AP310.htm.

Product Information—Cargill Industrial Oils & Lubricants, Soybean Oil, www.techoils.cargill.com/products/soy.htm.

Product Information—Cargill Industrial Oils & Lubricants, Canola Oil, www.techoils.cargill.com/products/canola.htm.

* cited by examiner

*Primary Examiner*—Jacqueline V. Howard
(74) *Attorney, Agent, or Firm*—Carmody & Torrance LLP

(57) ABSTRACT

An environmentally safe lubricating composition comprising a suspension of submicron molybdenum disulfide in canola oil is disclosed. Preferably the canola oil comprises trimethylol propane trioleate ester. In combining the molybdenum disulfide with the canola oil it preferred that the high shear mixing occur in the presence of a magnetic field.

13 Claims, No Drawings

METHOD OF MANUFACTURING ENVIRONMENTALLY SAFE LUBRICATING COMPOSITION

FIELD OF INVENTION

This invention relates to an improved composition for lubrication and a process for making that composition. The composition and process of this invention produce improved lubricating results with less ecological and safety dangers than current lubricants.

BACKGROUND OF THE INVENTION

The primary purpose of lubrication is the separation of moving surfaces to minimize friction and wear. Several distinct regimes are commonly used to describe the fundamental principles of lubrication. These range from complete separation by a fluid lubricant, through partial separation in boundry lubrication, to dry sliding where solid material properties and surface chemistry dominate. Application of basic considerations often enable an optimum match of machine design and material selection with lubricant and method of lubrication.

Machines of all types require lubrication. The quality of the lubrication provided greatly affects the efficiency, service life and other aspects of performance of the machine. Of particular importance in this regard are machining operations, such as cutting, milling and drilling, where lubricants/coolants are essential to the machining operations. The lubricating requirements involving new high strength, high toughness metal alloys can be particularly demanding. Thus, increasing technical demands are being placed upon lubricants.

At the very same time, ecological and safety concerns are also demanding the use of safer, more biodegradable compositions than the heavily petroleum based and toxic compositions of the past. Therefore there remains unanswered needs for environmentally friendly and health safe compositions that yield lubricating qualities which meet today's demanding specifications.

As noted, one of the most demanding applications for lubricants today is in precision machining of high strength, high toughness alloys. In these machining applications, in general, there are five attributes that are measured when considering lubricant performance:

(1) The lubricant composition lubricates the cutting edge/chip/workpiece interfaces so that chips will slide over the cutting tool surfaces with minimum friction thereby generating minimal frictional heat and cutting tool wear. It must also prevent build-up at the cutting edges and extend tool life.

(2) The lubricant composition must conduct heat away from the operation.

(3) The lubricant composition must be able to penetrate the interfaces.

(4) The lubricant composition must not be corrosive to the surfaces of the work, the machine or the tools.

(5) The lubricant composition must be able to carry away loose chips from the cutting edges.

In satisfying the foregoing requirements in demanding applications a good lubricant will extend machine and tool service life while producing excellent work.

Many prior lubricants have been based on a refined petroleum base stock. U.S. Pat. No. 4,203,854 discusses a lubricant based on a mixture of refined petroleum and molybdenum disulfide with other additives. U.S. Pat. No. 5,792,728 discusses a composition comprising molybdenum disulfide, soap flakes and polytetrafluoroethylene. Each of the foregoing two patents are incorporated herein by reference in their entirety.

It is thus an object of the invention to disclose a lubricant composition, and a process for creating that composition, which satisfy all of the foregoing qualities, even in the most demanding applications, yet is also more environmentally friendly and safe to use than similar prior lubricants.

It should be further noted that, although much of the foregoing discussion relates to machining operations, the lubricant composition of this invention can also be used in other applications such as lubricating gasoline and diesel engines and other similar lubrication operations.

SUMMARY OF THE INVENTION

This invention is therefore directed to a composition, and process for creating said composition, for use in various lubrication applications. The foregoing objectives can be accomplished with a lubricant composition comprising:

(1) Molybdenum disulfide particles with a mass mean size of less than about 1 micron; preferably less than about 0.9 microns and most preferably from about 0.1 to 0.6 microns; and (2) lubricating base oil(s), preferably selected from the group consisting of soybean oil, canola oil, other vegetable oils and mixtures of the foregoing;

wherein the molybdenum disulfide particles are suspended within the lubricating base oil(s). The lubricant composition may also comprise other performance additives.

The lubricant composition is prepared by adding the molybdenum disulfide particles to the lubricating base oil(s) with sufficient high shear mixing to suspend the molybdenum disulfide particles in the lubricating base oil(s). Preferably the high shear mixing is performed in the presence of a magnetic field.

DETAILED DESCRIPTION OF THE INVENTION

The inventors herein disclose an improved lubricant composition comprising:

(1) molybdenum disulfide particles with a mass mean diameter of less than about 1 micron, preferably less than about 0.9 microns and most preferably from about 0.1 to 0.6 microns; and (2) lubricating base oil(s), preferably selected from the group consisting of soybean oil, canola oil, other vegetable oils and mixtures of the foregoing;

wherein the molybdenum disulfide particles are suspended within the lubricating base oil(s).

Molybdenum disulfide generally has a hexagonal structure with sixfold symmetry, although a rhombohedral structural is also known. The hexagonal layer lattice structure of $M_OS_2$ results in easy cleavage of the crystal, thereby providing its inherent lubricity and low coefficient of friction. The choice of molybdenum disulfide is important to both the lubricating functionality of the composition as well as to the stability of the suspension created. Thus it is important that the molybdenum disulfide (sometimes equivalently referred to as molybdenum sulfide) have a mass mean diameter (size) of less than about 1 micron, preferably less than about 0.9 microns and most preferably from about 0.1 to 0.6 microns. Molybdenum disulfide, suitable for use in this invention may be commercially obtained from Climax Molybdenum Corporation. The particular particle size for the molybdenum disulfide, within the foregoing ranges, can be selected according to the lubrication requirements of a particular application.

The lubricating base oil(s) can be chosen from a variety of petroleum based oils. However, from ecological and safety points of view, it is preferable to use vegetable oils, most preferably soybean oil, canola oil and mixtures of the two. In choosing the base oils, consideration must be most importantly given to the lubrication application, the resistance of the oils to oxidation, the smoke point of the oils, oil viscosity and the ability of the oils to suspend the molybdenum disulfide particles.

As noted, it is most preferable for the lubricating base oil(s) to be fatty acid vegetable oils such as soybean oil and/or canola oil, since these oils can properly meet the lubrication requirements while being environmentally friendly and safe to handle. If canola oil is used, preferably it is a methyl ester of canola oil with a carbon chain length from 16 to 22, most preferably from 18 to 22. Preferably it has a high oleic content and most preferably it also comprises trimethylolpropane trioleate ester. Agripure 310™ or Agripure 85™ available from Cargill, Incorporated are preferred for use in this invention. Preferably the canola oil comprises at least 5% (most preferably at least 10%) by weight trimethylolpropane trioleate ester as an additive thereto. These particular canola oils provide superior lubrication properties in conjunction with extended oxidation resistance. At the same time, these oils are biodegradable and safe to handle. For best performance the oleic content of the canola oil should be at least 85% by weight C18:1 unsaturation. Preferably canola oil comprises at least 40% by weight of the lubricating composition and most preferably ranges from 75% and 99% by weight most preferably the canola oil is primarily monounsaturated.

It may be preferable to combine the canola oil with soybean oil in the lubricating base oil component. If used, preferably the concentration soybean oil ranges from 10% to 75% by weight of the lubricating composition, most preferably from 10% to 40% by weight. Preferred soybean oils include soy esters, preferably methyl esters with carbon chain lengths from 16 to 22, most preferably from 18 to 22. Most preferably the soy oil has a high oleic content of at least 85% by weight C18:1 unsaturation. Preferred soybean oils for use in this invention include Soy Methyl Esters and FAME, available from Cargill, Incorporated and Soy Methyl Esters, available from Archer Daniels Midland Company. Again, preferably the soy oil is primarily monounsaturated.

As noted petroleum based oils can also be used, but are not preferred for environmental and safety reasons. If used, the petroleum based oils may be either napthenic or paraffinic, but napthenic oils are preferred to paraffinic. The viscosity and other lubricating properties of the oil may be selected to match the application.

The lubricating composition may also comprise other performance enhancing additives, such as viscosity index improves, corrosion inhibitors, antioxidants, anti-wear agents, anti-foaming agents, surfactants and pour point depressants. The presence and concentration of additives of this type will depend upon the particular application for the lubricating composition.

If used, viscosity index improvers may include polyisobutylene and polymethacrylates. Commercially, polymethacrylates can be obtained from the Rohm & Haas Company under the trade name, Acryloid. The concentration of the viscosity index improver may range from 0 to 2% by weight of the lubricating composition.

Antioxidants are well known in this industry and include hindered phenols, polyvalent metal salts derived from a wide variety of diester dithiophosphonic acids, alkaline earth metal thiophenates, triazoles and imidazoles. The concentrations of antioxidants in the lubricating composition may range from 0 to 3% by weight.

Conventional surfactants, pour point depressants, and anti-foaming agents may also be employed. If used, generally the concentrations of these additives may range from 0 to 2% by weight each.

In order to manufacture the lubricating composition, it is important for performance, stability and shelf life considerations to obtain an excellent suspension of the molybdenum disulfide particulate in the base oils. The inventors have found this to be a particularly challenging task.

Thus the inventors have found it most beneficial to combine the base lubricating oil(s) and if used, the performance enhancing additives, first. Then, with high shear mixing, add the molybdenum disulfide particulate. Preferably the high shear mixing is conducted in an aerated tank with mixing time sufficient to disperse the molybdenum disulfide particles.

The inventors have surprisingly discovered that it is beneficial to conduct the high shear mixing in the presence of a magnetic field which is a stronger magnetic field than the earth's natural magnetic field. Preferably the high shear mixing occurs in a magnetic field with a magnetic strength of at least 12,000 Gauss. This can be accomplished, for example, by placing several 60 pound permanent magnets in a 275 gallon mixing tank. The inventors have discovered that mixing in the presence of such a magnetic field creates a suspension of molybdenum disulfide particulate which is far superior in performance and stability than suspensions created without the presence of such a magnetic field. For example, suspensions prepared in the presence of a magnetic field will exhibit useful shelf lives of 5 to 25 times longer than similar suspensions prepared without a magnetic field.

The following examples should be taken as illustrative of the instant invention, but should not be taken as limiting in any way.

EXAMPLE I 275 gallons of a lubricating composition comprising the following ingredients was prepared:

| Component | Concentration (% wt.) |
|---|---|
| Agripure 310 Canola Oil[1] | 49 |
| Agripure 85 Canola Oil[1] | 49 |
| Molybdenum disulfide (avg. particulate size by weight 0.8 microns)[2] | 2 |

[1]Available from Cargill, Inc.
[2]Available from Climax Molybdenum Corporation

All of the ingredients other than the molybdenum disulfide were added to a 275 gallon mixing tank with a mechanical mixer with aeration and two 60 pound magnet evenly dispersed against the interior wall of the mixing tank, with the high shear mixer rotating at 120 rpm. The molybdenum disulfide particulate was added slowly. Mixing continued for 15 minutes.

The resulting lubricating composition maintained an acceptable dispersion of the molybdenum disulfide for more than 6 months and exhibited excellent lubricating performance.

EXAMPLE II

Example I was repeated except that the magnets were removed from the mixing tank. The resulting lubricating composition maintained an acceptable dispersion for only about 2 weeks.

We claim:

1. A process for manufacturing a lubricating composition, said process comprising:

(a) combining molybdenum disulfide with a weight average particle size less than 1 micron with lubricating base oil to form a combination; and (b) subjecting said combination to mixing in the presence of a magnetic field which magnetic field is stronger than the earth's natural magnetic field.

2. A process according to claim 1 wherein the magnetic field has a magnetic strength of at least 12,000 Gauss.

3. A process according to claim 1 wherein the lubricating base oil comprises canola oil.

4. A process according to claim 1 wherein the lubricating base oil comprises trimethylolpropane trioleate ester.

5. A process according to claim 1 wherein the lubricating base oil comprises canola oil with carbon chain lengths of from 18 to 22 carbons.

6. A process according to claim 1 the combination comprises from 80 to 99.9 weight percent canola oil and from 0.1 to 5 weight percent molybdenum disulfide.

7. A process according to claim 1 wherein the combination also comprises at least one material selected from the group consisting of viscosity index improvers, corrosion inhibitors, antioxidants, antiwear agents, anti-foaming agents, surfactants and pour point depressants.

8. A process according to claim 2 wherein the lubricating base oil comprises trimethylol propane trioleate ester.

9. A process according to claim 2 wherein the lubricating base oil comprises canola oil with carbon chain lengths of from 18 to 22 carbons with one unsaturation.

10. A process according to claim 2 wherein the combination comprises from 80 to 95 weight percent canola oil and from 0.1 to 5 weight percent molybdenum sulfide.

11. A process according to claim 8 wherein the combination also comprises soybean oil.

12. A process according to claim 9 wherein the combination also comprises soybean oil.

13. A process according to claim 10 wherein the combination also comprises soybean oil.

* * * * *